US006186502B1

(12) United States Patent
Perkins

(10) Patent No.: US 6,186,502 B1
(45) Date of Patent: Feb. 13, 2001

(54) MULTI-TIERED SYSTEM FOR SPORTS WAGERING

(76) Inventor: Walter T. Perkins, R.R. 6, Box 219, Greensburg, PA (US) 15601

( * ) Notice: Under 35 U.S.C. 154(b), the term of this patent shall be extended for 0 days.

(21) Appl. No.: 09/353,966

(22) Filed: Jul. 15, 1999

(51) Int. Cl.[7] ..... A63B 71/00

(52) U.S. Cl. ..... 273/138.1; 273/139; 273/138 R; 463/16; 463/30

(58) Field of Search ..... 273/138.1, 138.2, 273/139, 148 R; 463/17, 16, 1, 30

(56) References Cited

U.S. PATENT DOCUMENTS

| | | | | |
|---|---|---|---|---|
| 4,087,092 | * | 5/1978 | Krause et al. | 273/138 A |
| 4,775,937 | | 10/1988 | Bell | 364/412 |
| 4,962,950 | * | 10/1990 | Champion | 283/67 |
| 5,317,135 | * | 5/1994 | Finocchio | 235/375 |
| 5,374,060 | * | 12/1994 | Goldberg | 273/139 |
| 5,489,096 | * | 2/1996 | Aron | 273/138 R |
| 5,687,968 | * | 11/1997 | Tarantino | 273/139 |
| 5,743,525 | * | 4/1998 | Haddad | 273/139 |
| 5,791,990 | | 8/1998 | Schroeder et al. | 463/17 |
| 5,938,200 | * | 8/1999 | Markowicz et al. | 273/246 |
| 5,949,042 | * | 9/1999 | Dietz, II et al. | 235/375 |

* cited by examiner

*Primary Examiner*—Mark S. Graham
*Assistant Examiner*—Dolores R. Collins
(74) *Attorney, Agent, or Firm*—Henderson & Sturm LLP

(57) ABSTRACT

A multi-tiered method for wagering on a sports event in such a manner that it becomes impractical for outside influences to attempt to alter the outcome of the sports event for illegal gains; wherein, the method involves choosing a first criteria dependent upon parameters that may be satisfied by the outcome of the sports event and having a second criteria that will be determined by an independent randomly generated data value and choosing a multi-variable data value that will hopefully match the second criteria that will be determined by an independent randomly generated data value and choosing a multi-variable data value that will hopefully match the second criteria; wherein, both choices are imprinted on a tamper proof wagering slip 11.

21 Claims, 1 Drawing Sheet

MULTI-TIERED SYSTEM FOR SPORTS WAGERING

BACKGROUND OF THE INVENTION

1. Field of the Invention

The present invention relates to the field of wagering systems in general and in particular to a multi-tiered system for sports wagering to both increase individual payoffs and to discourage illegal activity.

2. Description of Related Art

As can be seen by reference to the following U.S. Pat. Nos. 5,374,060; 4,775,937; 5,743,525; 5,687,968; and 5,791,990, the prior art is replete with myriad and diverse wagering systems.

While all of the aforementioned prior art constructions are more than adequate for the basic purpose and function for which they have been specifically designed, they are uniformly deficient with respect to their failure to provide a simple, efficient, and relatively foolproof method of insuring that the incentive to either "fix" sporting events or "shave points" to alter the outcome of a sporting event for illicit purposes will be virtually eliminated.

As most casual and professional gamblers are all too well aware, sports wagering is a multi-billion dollar a year industry which unfortunately under current wagering systems makes it attractive to organized crime and others to slant the odds of winning a wager in their favor by taking steps to alter or otherwise influence the outcome of sporting events.

As a consequence of the foregoing situation, there has existed a longstanding need for a new and improved method of wagering on competitive events such as sports or athletic contests that adds an independent and random variable to identify the winning wagerer; and, the provision of such a method is a stated objective of the present invention.

BRIEF SUMMARY OF THE INVENTION

Briefly stated, in most jurisdictions in the United States, wagering on events such as athletic contests is illegal. This is in part due to a concern that allowing betting on such contests would lead to attempts to "fix" outcomes to win wagers. Another detriment is that individual betters would need to wager comparatively large amounts of money on a typical "single result" event to approach the payoff of games like the "numbers games" or "lotteries" performed in many states or they would need to bet numerous events with a smaller sum of money risked repeatedly. In both cases, the total amount of money that would have to be risked to even approach the high payoff totals of state lotteries would be enormous. Pursuing the jackpots with illegal vendors has led many individuals to financial ruin, or worse.

By adding another step, in the form of an independent, random number lottery or similar game, both of the detriments to betting on sports can be reduced or eliminated.

First, this "Multi-tier" system reduces the temptation to fix outcomes by adding a step in the form of a random lottery. If a football team is playing, for example, the system would not allow large bets a great likelihood of success since even after "fixing" the outcomes or points of the game, a party would then have to participate in a random number game to hit the "jackpot". Without a dependable payout on large bets, "fixing" an athletic contest makes no sense as an investment.

In addition, the random second step would allow an individual to earn a chance at a larger payout on a smaller bet. This is similar to the large proportional winnings now available in many of the random number lotteries. Finally, the addition of a second tier would more likely force bettors to recognize that their activities faced a "chance" or "random" possibility of success instead of suggesting that sports betting was prone to handicapping systems or other methods of analysis for outcome prediction. The publication of point spreads, odds and other betting information in the popular media demonstrates the scale of illegal betting and it is a testament to the integrity of owners and sports personnel that the games are not corrupted in the present environment.

This invention is a method of wagering on sports events or other contests and reduces or eliminates the attractiveness of "rigging" or "fixing" the contest. The method is to require the wagerer to select an outcome or outcomes in the event and also to take part in a random contest or contests that are independent of the athletic event to win the wager.

There are numerous sports and competitive events this system may apply to. There are also numerous gaming and lottery systems available to implement this method. The most simple random game would be a "drawing type" contest where those who picked a particular outcome of a competitive event are represented by tickets in a common pile. If the group correctly picked the competition event's outcome, winners would be drawn at random. Another method is to sell tickets identifying an event's outcome and include a chance in a random number drawing like the present state lotteries to determine winners. The actual score totals, performance against "spreads" (which are point numbers added to a weaker team's score or subtracted from a stronger team's score to arrive at a level to determine a win in a bet), order of finish in an event, performance statistics, wins against handicaps or betting spreads can be used to determine the qualifiers from the sports event.

This next component would enable the processor of the bets to keep the economic rewards of betting from becoming a temptation to control game results.

The key to the efficacy of the second tier of the wagering method is to control the investment returns or expected monetary value of the wager so that it does not become economically feasible to attempt to fix the outcome or outcomes of the events. Alternatively, it may be made logistically difficult to buy the number of tickets required to assure a win even if the result or results of the contest are assumed to be a given.

The definition of expected monetary value is the probability of winning applied to the value of the win. For example, if a drawing had a prize of $1,000 and sold 100 tickets, each ticket would have an expected monetary value of $10. ($1/100 \times 1000$). If the tickets cost only $1.00 each, this wager would be very attractive. If a payout on a sports event was millions, it might be worth a wagerer's efforts or money to "fix" a sports event and then buy all possible winning tickets. With enough expected monetary value, even the probability of duplicate winners, taxes and other expenses could make it an attractive proposition.

There are specific measures that enable a random game to protect the integrity of the sporting or competitive event. To minimize the risk of corruption, the second game must be designed to reduce the attractiveness of buying every possible combination. Present state lotteries have confronted this issue and have apparently avoided most attempts to win random game jackpots by the sheer number of tickets needed to approach the coverage of 30–100+million possible combinations.

Another way to avoid possible profits in "fixing" the competitive event, the operation of the random game could work with a defined payout like the 500–1 payout on the usual 1,000–1 odds of daily numbers. With a constant comparatively small payout per dollar risked on the random game, "fixing" is not sensible.

To achieve large jackpots and their attractiveness to the wagerer, the number universe in the random game could be increased as the jackpot grew, to make covering every outcome less attainable as discussed above. In addition, sections of the random game could include other elements of the athletic contest or event such as points, stroke totals, hits, official time, uniform number of a player who accomplished a feat identified before the game or any other salient statistic from the contest that would be hard to arrange.

There are numerous items from sports contests that could be included. In baseball, for example, the numerous games played in a season could accommodate a simple, repetitive system. This could consist of the selection of the winner of a game or series and a simple lottery like the three or four digit random number lotteries now present in many states to determine a winner. The issuer could also award smaller prizes for having a part of the ticket correct; something that is rarely done in present lottery games that require the selection of only three or four numbers. To build a large jackpot, a ticket offerer could easily raise the standard for winning the largest jackpot and require the selection of a winner of a game or games, line scores (runs, hits, and errors) or other statistics and then apply this to a random lottery. Similarly, in hockey, goals ("even-strength" or "short-handed"), shots on goal, power plays, stars of a game, save percentage or other statistics on results could be used as an additional hurdle to the result of the game.

Some events, like American Football, have similar statistics but play a limited number of games. With appropriate market research, a number lottery could be designed to maximize the revenue from the limited number of games and possibly incorporate popular statistics or achievements from the game.

The issuer of the tickets could also award tickets, entertainment vouchers, automobiles, scholarships, homes, clothing or other items that might be attractive to consumers but not to large scale gamblers or syndicates. Finally, the ticket issuer's portion of the possible winning "jackpot" could also be increased as a way to reduce the investment attractiveness of buying all combinations of the random game.

Although many random games could be used as the second tier of this invention, the most likely scenario is that the random game would be similar to the present state number lotteries.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

The multi-tiered system for sports wagering that forms the basis of the present invention comprises a method for wagering on the outcome of a sports contest or the like wherein the ultimate outcome of the athletic event comprises the first criteria for establishing the wagerer or class of wagerers that will share in the total wagering pool conditional upon those wagerers who have met the first criteria possessing a wagering slip or ticket that has a randomly generated component or set of values whose criteria are established during the athletic contest and/or randomly generated independent of the athletic contest.

Figure 1:
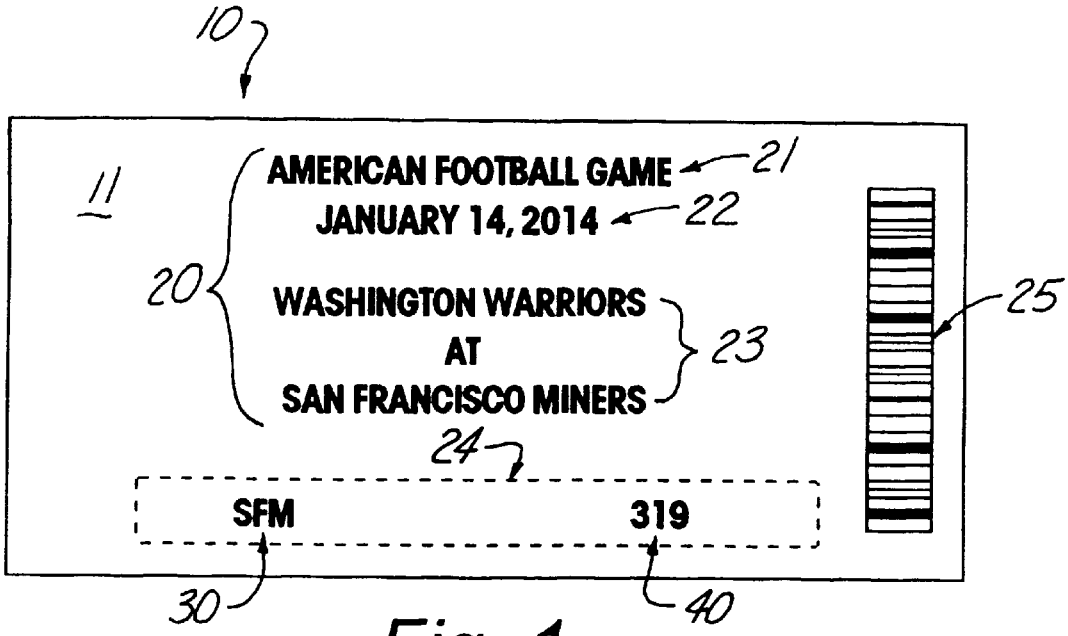
FIG. 1 is one example of a wagering slip incorporating the teachings of this invention; and, FIG. 2 is another example of a wagering slip incorporating the teachings of this invention.
Figure 2:
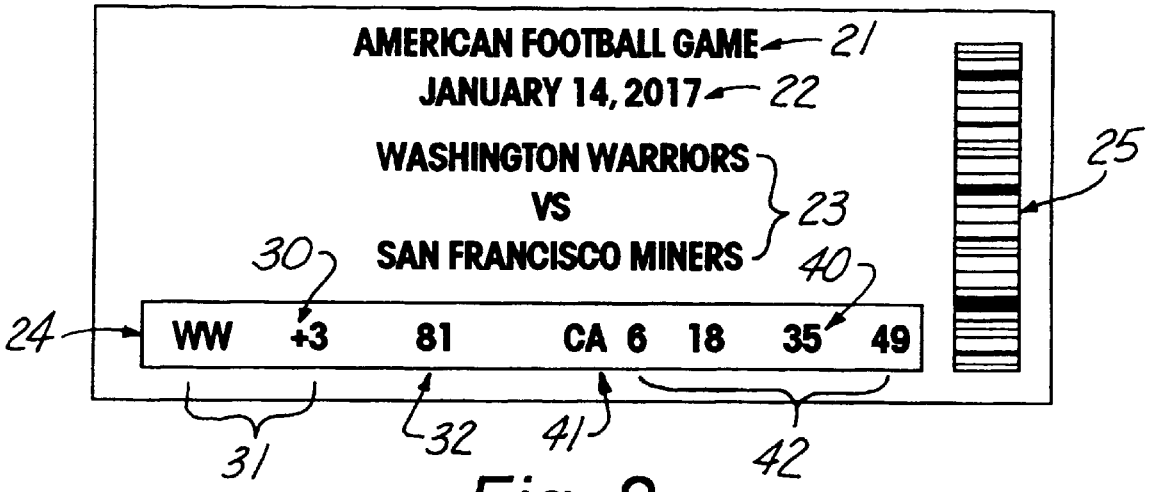

As can be seen by reference to FIGS. 1 and 2, a typical wagering slip or ticket 10 that would incorporate the teachings of this invention, would have a ticket face 11 having generic information related to a specific athletic contest or event preprinted thereon and designated generally as 20. This generic information would include the nature or identity of the athletic contest 21, the date that the event would take place 22, and the identify of the athletic teams or competitors that would be involved in the event 23.

Furthermore, the ticket face would have two additional standard elements provided thereon which would include a tamper proof data entry box 24 and a bar code verification strip 25 whose purpose and function will be described presently.

In the most basic embodiment of the method that forms the basis of the present invention illustrated in FIG. 1, it can be seen that the data entry box 24 contains basic identification data 30 relating to the winner of the athletic contest and directly variable data 40 that can be chosen either directly by the wagerer or randomly generated by a computer.

In this first example, the basic identification data 30 is chosen by the wagerer without any weighing or handicap features and simply represents the wagerers choice of the ultimate winner of the athletic contest or event and the multi-variable data can be selectively chosen either by the wagerer or a random data generating device depending on the guidelines established by the organization that is empowered and authorized to oversee and regulate this legal gaming method.

It should further be noted that in this first example, hypothetically half of the wagerers would meet the first criteria for picking the winner of the athletic contest and as a consequence, there would be a potentially large pool of wagerers that would meet the first criteria and thereby qualify for the second criteria that would identify those individuals that would share in the distribution of the amount of money in the wagering pool. In the example illustrated in FIG. 1, a three-digit randomly generated data value constitutes the second criteria for claiming a portion of the wagering pool and given the large pool of the wagerers that should have qualified for the secondary criteria; there should be one or more wagerers who meet both criteria to determine the winners of the wagering contest.

As a consequence, each athletic contest should produce at least one wagerer who will be compensated far in excess of their individual contribution to the wagering pool; however, not to the extent of many multi-state lotteries.

In the next example of the preferred embodiment illustrated in FIG. 2, the basic identification data 30 may contain weighted or handicapped data 31 relating to one of the participants in the athletic contest plus event generated data 32 that will be generated by the actual outcome of the event but will not be dependent upon the identity of the ultimate winner of the contest.

In this particular example, one of the contestants in the athletic event will be given a handicap which potentially allow a wagerer who chose a losing competitor 31 to satisfy the first criteria of the multi-tiered wagering system of this invention.

In addition, other event-generated data 32 may be used to further reduce the wagerers to who meet the first criteria by forcing the wagerer to consider other variables such as the combined total score 32 of both teams in order to satisfy the aforementioned first criteria.

As a consequence of the foregoing situation, a substantially reduced pool of wagerers will satisfy both the handicapped or weighted data 31 and the event generated data 32 that will satisfy the first criteria and qualify them to attempt to satisfy the second multi-variable random generated data 40.

In this particular example, each wagering slip will have alpha 41 and numeric 42 data imprinted thereon; wherein, the alpha-numeric data 41, 42 may be chosen by the wagerer or produced by a random data generating device depending on the guidelines established by the organization that is empowered and authorized to oversee and regulate this legal gaming method.

In this example, the pool of wagerers that satisfy the first criteria will be substantially reduced by the requirement that the wagerer select either actual or weighted data 31 relative to the winner of the athletic event as well as event-generated data 32 that is independent of either the actual or handicapped outcome of the event.

Furthermore, the second criteria involves a much enhanced multi-variable randomly generated data base 40 which may or may not determine a winning wagerer of the wagering pool based on a single athletic event due to the lottery style second criteria employed.

As a consequence, the second example could be implemented on a national lottery style basis wherein the first criteria could be focused on a national sports organization such as major league baseball, professional or college football or basketball, hockey, NASCAR or the like which would be sponsored either by the Federal Government and/or the different governing bodies of the various national sports organizations.

At this juncture, it should be apparent that the multi-tiered system for sports wagering that forms the basis of the present invention virtually eliminates the incentive to fix sporting events for illegal gains and also can be customized to product payouts to successful wagerers that are selected multiples of their initial wagered amount; wherein, those multiples can be mathematically computed to provide a wide variety of average payouts ranging from modest return to large lottery caliber sums.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A multi-tiered method for wagering on a sports event involving at least two competitors wherein the method comprises the steps of:

a) choosing one of the at least two competitors to satisfy a first criteria based on a predetermined number of parameters that may be satisfied by the outcome of the sports event; wherein, one of the predetermined number of parameters includes the winner of the sports event as determined by a handicap system:

b) registering the choice form step a) on a wagering slip;

c) establishing a second criteria based on an independent randomly generated data value; and d) attempting to match the independent randomly generated data value by choosing a selected multi-variable data value that is imprinted on the wagering slip; wherein, said multi-variable data value is selectively chosen from among one of the following choices: 1) the specific choice of the wagerer; and, 2) the output of a random data generating device.

2. The method as in claim 1; wherein, choice from step a) and the selected multi-variable data value are imprinted on a tamper proof strip provided on the wagering slip.

3. The method as in claim 2; wherein, the wagering slip is further provided with a bar code which is correlated with the choice from step a) and the selected multi-variable data value.

4. The method as in claim 1; wherein, one of the predetermined number of parameters includes the actual winner of the sports event.

5. The method as in claim 4; wherein, another of the predetermined number of parameters includes the total combined score of the competitors.

6. The method as in claim 5; wherein, yet another of the predetermined number of parameters includes the winning margin between the competitors.

7. The method as in claim 4; wherein, another of the predetermined number of parameters includes the elapsed time of the sports event.

8. The method as in claim 1; wherein, said separate independent randomly generated data value includes a combination of alpha-numerical values.

9. The method as in claim 1; wherein, said separate independent randomly generated data value comprises a series of numerical values.

10. The method as in claim 1; wherein, said separate independent randomly generated data value comprises a series of alphabetical values.

11. The method as in claim 1; wherein, a winning wagering slip must satisfy both the first criteria based on the outcome of the sports event and the second criteria based on the independent randomly generated data value that is generated subsequent to the conclusion of the sports event.

12. A multi-tiered method for wagering on a sports event involving at least two competitors wherein the method comprises the steps of:

a) choosing one of the at least two competitors to satisfy a first criteria based on a predetermined number of parameters that may be satisfied by the outcome of the sports event; wherein, the predetermined number of parameters include the actual winner of the sports event; and, the elapsed time of the sports event;

b) registering the choice from step a) on a wagering slip;

c) establishing a second criteria based on an independent randomly generated data value selectively chosen from among one of the following choices: 1) the specific choice of the wagerer; and, 2) the output of a random data generating device; and d) attempting to match the independent randomly generated data value by choosing a selected multi-variable data value that is imprinted on the wagering slip.

13. The method as in claim 12; wherein, the choice from step a) and the selected multi-variable data value are imprinted on a tamper proof strip provided on the wagering slip.

14. The method as in claim 13; wherein, the wagering slip is further provided with a bar code which is correlated with the choice from step a) and the selected multi-variable data value.

15. The method as in claim 12; wherein, another of the predetermined number of parameters includes the winner of the sports event as determined by a handicap system.

16. The method as in claim 12; wherein, said separate independent randomly generated data value includes a combination of alpha-numerical values.

17. The method as in claim 12; wherein, said separate independent randomly generated data value comprises a series of numerical values.

18. The method as in claim 12; wherein, said separate independent randomly generated data value comprises a series of alphabetical values.

19. The method as in claim 12; wherein, a winning wagering slip must satisfy both the first criteria based on the outcome of the sports event and the second criteria based on the independent randomly generated data value that is generated at the conclusion of the sports event.

20. The method as in claim 12; wherein, another of the predetermined number of parameters includes the total combined score of the competitors.

21. The method as in claim 12; wherein, another of the predetermined number of parameters includes the winning margin between the competitors.

* * * * *